United States Patent [19]

Fukami

[11] 3,937,910

[45] Feb. 10, 1976

[54] TIMER HAVING A VARIABLE OPERATION PERIOD

[75] Inventor: Tadashi Fukami, Kawasaki, Japan

[73] Assignee: Jeco Kabushiki Kaisha, Japan

[22] Filed: Apr. 16, 1974

[21] Appl. No.: 461,291

[52] U.S. Cl. ..... 200/35 R; 200/38 R; 58/9; 58/22.5

[51] Int. Cl.[2] ..... H01H 7/08

[58] Field of Search .... 200/33 R, 33 B, 35 R, 35 A, 200/37 R, 38 R, 38 A, 38 FA, 38 FB, 38 F, 38 B, 38 CA, 38 C, 38 BA, 153 L, 153 LA, 153 LB, 37 A; 58/9, 22.5

[56] References Cited

UNITED STATES PATENTS

| | | | |
|---|---|---|---|
| 2,354,368 | 7/1944 | Gallagher | 200/38 R |
| 2,545,719 | 3/1951 | Wedeberg | 200/38 R X |
| 2,802,913 | 8/1957 | Weiss | 200/33 R |
| 3,214,985 | 11/1965 | Danek et al. | 200/38 R X |
| 3,264,818 | 8/1966 | Morrison et al. | 200/35 R X |
| 3,456,123 | 7/1969 | Pihl | 200/38 R X |
| 3,625,000 | 12/1971 | Hermle | 200/35 R X |
| 3,818,157 | 6/1974 | Voland et al. | 200/153 LB X |
| 3,825,702 | 7/1974 | Murata et al. | 200/35 R |

*Primary Examiner*—James R. Scott
*Attorney, Agent, or Firm*—Wolfe, Hubbard, Leydig, Voit & Osann, Ltd.

[57] ABSTRACT

A timer operative by means of a clock mechanism and having a variable operation period, wherein a main cam plate and a subsidiary cam plate are mounted coaxially on a common shaft so that they are rotatable relative to each other, each of said main and subsidiary cam plates having recessed peripheral portions and protruded peripheral portions. A single operation lever pressingly bears against the peripheral portions of said main and subsidiary cam plates so that, when the recessed peripheral portions of said main and subsidiary cam plates are brought into alignment with each other, the operation lever can drop into said aligned recessed peripheral portions.

11 Claims, 13 Drawing Figures

TIMER HAVING A VARIABLE OPERATION PERIOD

BACKGROUND OF THE INVENTION

Various types of timers have been proposed heretofore for use in the industrial field for various purposes, for instance, for opening a valve at a preselected time and for a preselected duration thereby to allow flow of water therethrough, for closing a switch to conduct an electric current, or for operating an ignition device. These known timers, however, require skill and experience and are so complicated and massive that they cannot be handled very conveniently; in addition, mechanical disorders are often encountered. The present invention intends to provide an easy-to-use, high-precision timer which is free from the disadvantages of conventional timers and highly flexible in use.

SUMMARY OF THE INVENTION

This invention relates to a timer, wherein a main cam plate and a subsidiary cam plate are mounted coaxially on a common shaft so that they are rotatable relative to each other for thereby developing signals for a desired number of actuations in a multiple day cycle.

It is a primary object of this invention to provide a low-cost timer having a simplified and compact construction.

Another object of this invention is to provide a high-precision, long-period timer.

Still another object of this invention is to provide a timer including minimum number of wear points so that it can be used for an extended period of time.

A further object of this invention is to provide a timer which is operable in a very simple manner.

BRIEF DESCRIPTION OF THE DRAWINGS

FIG. 8 is an enlarged plan view of the main portion of the timer according to another embodiment of this invention.

FIG. 8A sets forth in perspective the relation of the cams and followers in FIG. 8.

DESCRIPTION OF THE PREFERRED EMBODIMENTS

Figure 4:
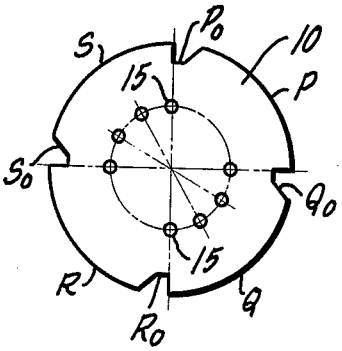
FIG. 4 is a front view of the main cam plate for the timer of this invention.

Referring first to FIGS. 1A to 1D, a main cam plate 10 is provided with four different recessed peripheral portions $P_o$, $Q_o$, $R_o$ and $S_o$. In the first embodiment illustrated in FIGS. 1 to 7, an operation lever 11 for developing signals is arranged so that it is operable in association with said recessed peripheral portions. The main cam plate 10 has protruded peripheral portions P, Q, R, and S (FIG. 4). A subsidiary cam plate 12 is arranged coaxially with the main cam plate 10 so that it is rotatable relative to said main cam plate 10. The subsidiary cam plate 12 is also provided with recessed peripheral portions $T_o$, $U_o$, $V_o$ and $Y_o$ as well as protruded peripheral portions T, U, V and Y.

The main cam plate 10 is fixedly mounted on a shaft 13 which is rotatable following to the rotation of a pointer dial 14. Arranged between the main cam plate 10 and subsidiary cam plate 12 are click stop pins 15 so that the subsidiary cam plate 12 can be rotated in three steps, in each step for 30° with respect to the main cam plate 10. Springs 16 are arranged so as to press the click stop pins 15 against the main cam plate 10. Extended through a rotary plate 18 attached to the subsidiary cam plate 12 is a selector lever 17 so that the subsidiary cam plate 12 can be rotated relative to the main cam plate 10 by operating the selector lever 17.

Figure 1D:
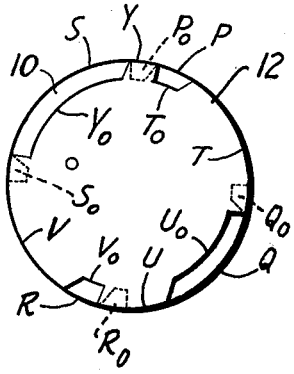
FIGS. 1A–1D are front views of the cam mechanism constituting the main portion of the timer according to the first embodiment of this invention, wherein FIG. 1D showing the cam mechanism in the position where the main cam plate and subsidiary cam plate are in alignment with each other, FIG. 1A showing the cam mechanism in the position where said cam plates are displaced from each other by 30°, FIG. 1B showing the cam mechanism in the position where said cam plates are displaced from each other by 60°, and FIG. 1C showing the cam mechanism in the position where said cam plates are displaced from each other by 90°.
Figure 1A:
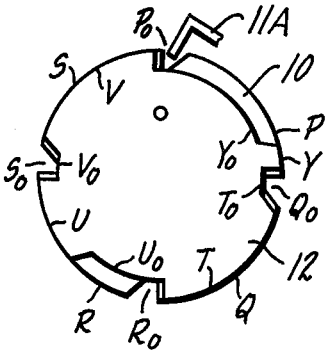

When the main cam plate 10 and subsidiary cam plate 12 are in the positions shown in FIG. 1A, or when the recessed peripheral portions $P_o$, $Q_o$, $R_o$ and $S_o$ of the main cam plate 10 are in alignment with the recessed peripheral portions $Y_o$, $T_o$, $U_o$ and $V_o$, respectively, the operation lever 11 is allowed to drop into the aligned recessed portions sequentially, thereby developing each time a predetermined signal. In other words a signal is developed every time the main cam plate 10 rotates 90°. This means that four separate signals are developed during one revolution of the main cam plate 10.

Figure 1B:
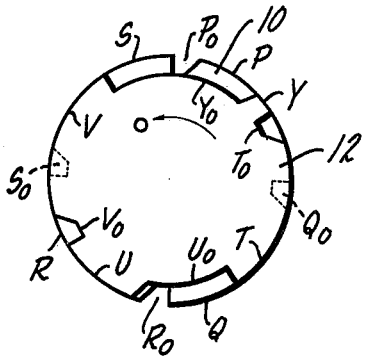

When the subsidiary cam plate 12 is then rotated another 30° with respect to the main cam plate 10, they are in the positions shown in FIG. 1B. In this position the recessed peripheral portions $P_o$ and $R_o$ of the main cam plate 10 are in alignment with the recessed peripheral portions $Y_o$ and $U_o$ of the subsidiary cam plate 12, respectively. The operation lever 11 is operable only when these aligned recessed peripheral portions reach the position in opposition to the operation lever 11. This means that a signal is developed every time when the main cam plate 10 rotates for 180°, or that two separate signals are developed during each one revolution of the main cam plate 10.

Figure 1C:
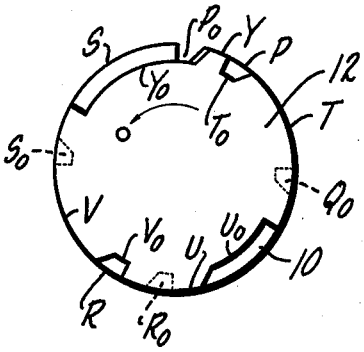
Figure 2:
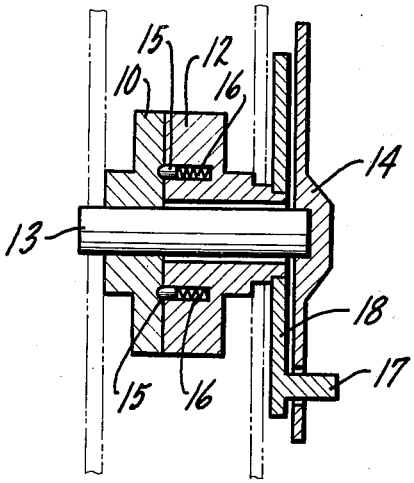
FIG. 2 is an axial sectional view of the timer according to this invention.

When the subsidiary cam plate 12 is rotated for still another 30° with respect to the main cam plate 10, or when the subsidiary cam plate 12 is rotated for 90° from the position shown in FIG. 1D, the subsidiary cam plate 12 and main cam plate 10 are in the positions shown in FIG. 1C. In this position the recessed peripheral portion $P_o$ of the main cam plate 10 and the recessed peripheral portion $Y_o$ of the subsidiary cam plate 12 are in alignment with each other. Thus the operation lever 11 is operable to develop a signal only when the aligned recessed portions reach the position in opposition to the operation lever 11. This means that a signal is developed every time when the main cam plate 10 makes one revolution.

The construction of the timer according to this invention which is provided with said cam mechanism as its main portion will further be described. The timer main body has a shaft 13 extended between a pair of parallel frame plates 20 and 21. The main cam plate 10 is press-fitted onto the shaft 13; while the subsidiary cam plate 12 is loosely mounted in the shaft 13 so that it is rotatable relative to the main cam plate 10. The pointer dial 14 which is made of a transparent plate carrying a pointer indicium 22 is fixedly mounted on the shaft 13. The pointer dial 14 is provided with a slot 23 through which a selector lever 17, secured to the member 12, extends outwardly. A cupped spring 24 serves to press a graduated dial plate 25 against the holder plate 20.

Figure 5:
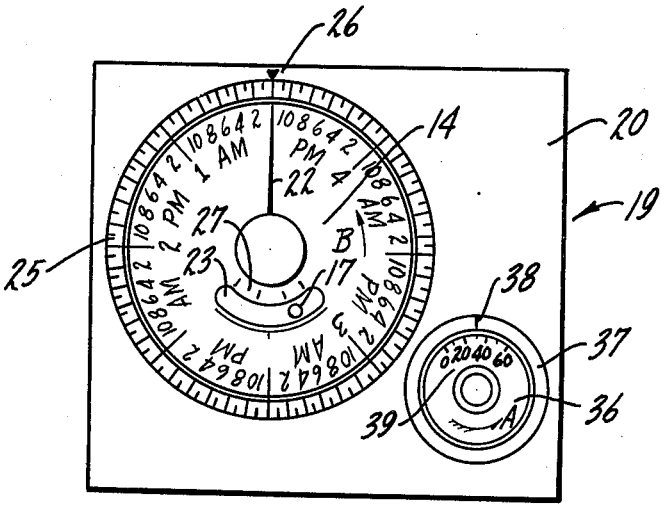
FIG. 5 is a front elevational view of the timer according to this invention.

As is seen from FIG. 5 the graduated dial plate 25 carries hour graduations representing the forenoon (AM) and afternoon (PM) hours of the first, second, third and fourth day in its circumferential areas from 0° to 90°, from 90° to 180°, from 180° to 270° and from 270° to 360° measured in the couter-clockwise direction, respectively.

A dial setting index 26 is marked on the holder plate 20. A scale 27 is adapted to indicate how many times the operation lever 11 operates during one revolution of the main cam plate 10. In the illustrated embodiment the scale 27 includes four different positions of which three are for indicating one, two and four times of signal development, respectively, and the remaining one position is the OFF position for indicating the inoperative position of the operation lever 11.

Figure 6:
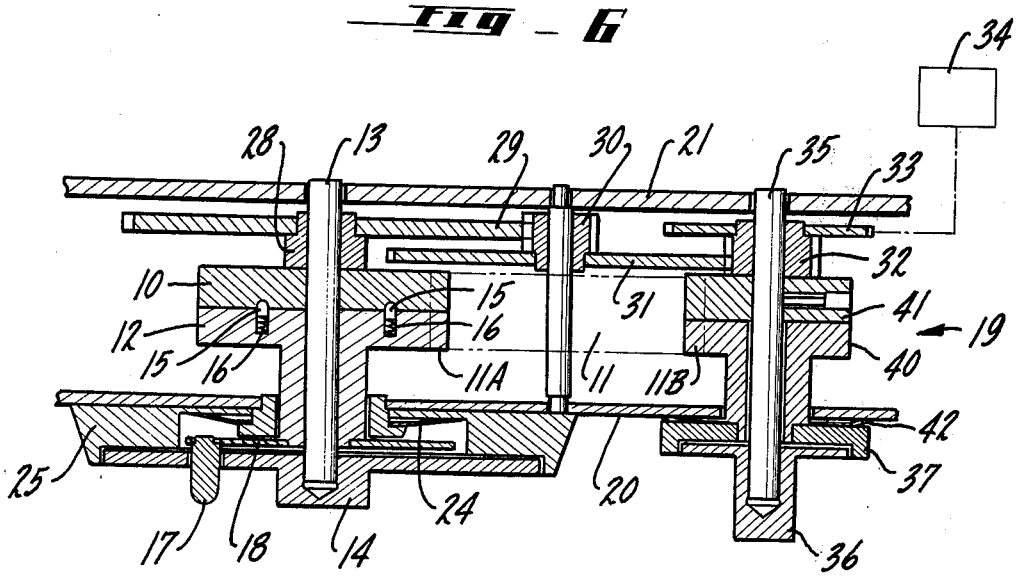
FIG. 6 is an enlarged plan view of the main portion of the timer according to this invention.
Figure 6A:
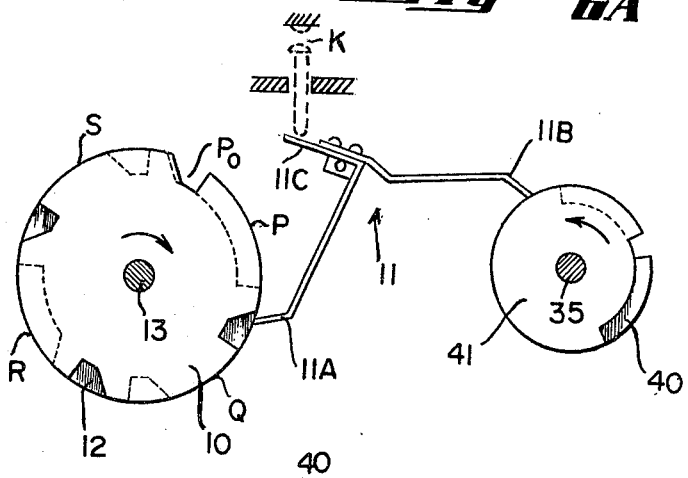
FIG. 6A sets forth in elevation the relation of the cams and followers in FIGS. 6 and 7.
Figure 6A:
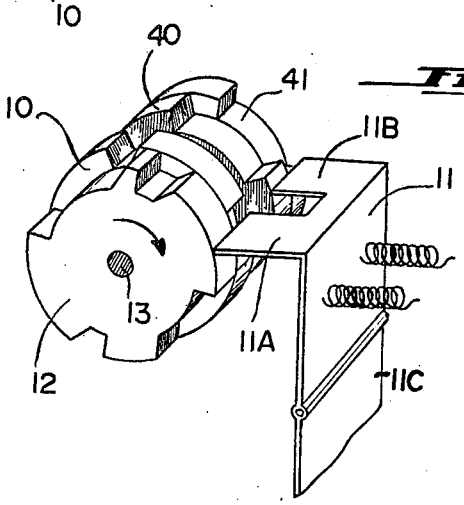
Figure 6:
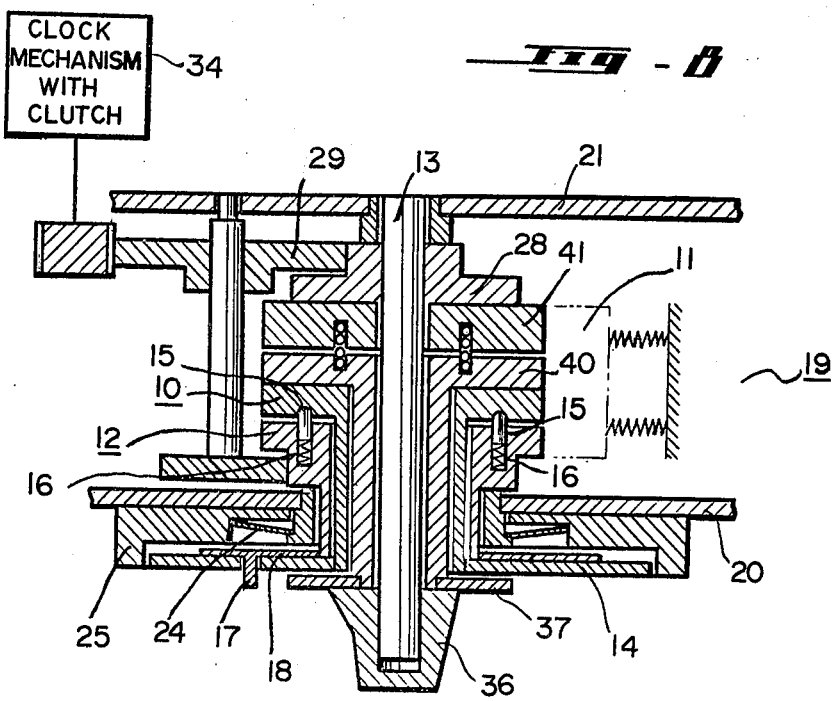

Gear 29 having a hub 28 is coupled through pinion 30, gear 31, pinion 32 and gear 33 to a clock mechanism 34 by way of a friction clutch (not shown). Bridgingly arranged between the holder plates 20 and 21 is a shaft 35 on which is press-fitted an operation time setting knob 36. Indicated at 37 is an operation time setting plate marked with an operation time setting index 38. The operation time setting knob 36 carries an operation time indicating scale 39 graduated at intervals of 10 minutes from 0 to 60 minutes. An operation time setting subsidiary cam plate 40 is connected to the operation time setting plate 37 and loosely mounted on the shaft 35 so that it is freely rotatable on the shaft 35; while an operation time setting main cam plate 41 is fixedly mounted on the shaft 35. A leaf spring 42 is arranged so as to press the operation time setting plate 37 against the operation time setting knob 36. The first arm 11A of the operation lever 11 is pressed into contact with the peripheral portions of the main cam plate 10 and subsidiary cam plate 12; while the second arm 11B is pressed into contact with the peripheral portions of the operation time setting subsidiary cam plate 40 and operation time setting main cam plate 41. The third arm 11C of the operation lever 11 serves to control the load such as a microswitch contact K (FIG. 6A) or a pilot valve. When the recessed peripheral portions of the operation time setting subsidiary cam plate 40 and the operation time setting main cam plate 41 are brought into alignment with each other, the second arm 11B will drop into the aligned recessed peripheral portions so that the load keeps operating until the second arm 11B is pushed out of the aligned recessed peripheral portions. In other words, the operation duration of the load can be controlled by varying the relative position of the operation time setting subsidiary cam plate 40 with respect to the operation time setting main cam plate 41. This means that the conducting duration of an electric current by way of the microswitch contact K or operation duration of a pilot valve, for example, can be controlled by use of the foregoing arrangement.

The operation of the timer according to this invention will be described as follows. The graduated dial plate 25 can be rotated until the hour graduation 10 PM of the first day reaches a position of alignment with the dial setting index 26. The operation time setting knob 36 is then rotated in the direction of arrow A, the operation time setting main cam plate 41 rotating together with the shaft 35. The shaft 35 rotates gear train 33, 32, 31 30 and 29, thereby rotating the pointer dial 14 until the pointer 22 marked thereon is in alignment with the graduation marked on the graduated dial plate 25 and representing the time at that time, for example 10 AM of the first day. Then the operation time setting plate 37 is rotated to rotate the operation time setting subsidiary cam plate 40, for example, until the operation time setting index 38 is in alignment with the graduation "20" included in the operation time indicating scale 39 which is formed on the operation time setting knob 36. In this position the operation duration of the load is set to 20 minutes.

Under these conditions if the selector lever 17 is set to "1" of the operation number indicating scale 27 (see FIG. 1A), then the operation lever 11 will drop into the recessed peripheral portions $P_o$, $Q_o$, $R_o$ and $S_o$ in this order during one revolution of the main cam plate 10. More specifically, the operation lever 11 will drop into the recessed peripheral portions every day when the main cam plate 10 rotates for 90°, thereby operating the load such as microswitch contact or pilot valve by means of the third arm 11C of the operation lever 11.

When the clock mechanism 34 is under operation, the pointer dial 14 rotates in the direction of arrow B by way of the gear train 33, 32, 31, 30 and 29. When the pointer 22 is brought into alignment with the dial setting index 26, the first arm 11A of the operation lever 11 reaches the position above the recessed peripheral portion $P_o$ of the main cam plate 10 and, at the same time, the second arm 11B reaches the position above the recessed peripheral portion of the operation time setting main cam plate 41. In this position these arms 11A and 11B simultaneously drop into the associating recessed peripheral portions, while the third arm 11C allows the load to keep operating for 20 minutes. Towards the end of this preset duration, the second arm 11B rides over the protruded peripheral portion of the operation time setting main cam plate 41 thereby to terminate the operation of the load.

When the pointer dial 14 further rotates in the same direction until the pointer indicium 22 reaches the graduation of 10 PM of the second day marked on the graduated dial plate 25, the first arm 11A of the operation lever 11 drops into the recessed peripheral portion $Q_o$ of the main cam plate 10 and simultaneously the second arm 11B drops into the recessed peripheral portion of the operation time setting main cam plate 41 in the similar manner as described previously, so that the load operates for another 20 minutes. After that, the load will start operating at 10 PM of the third day and at 10 PM of the forth day when the operation lever 11 operates in the similar manner.

When the selector lever 17 is then set to "2" of the operation number indicating scale 27 (see FIG. 1B), the pointer dial 14 will rotate in the direction of arrow B. At the time when the pointer indicium 22 is in alignment with the dial setting indicium 26, the first arm 11A of the operation lever 11 will drop into the recessed peripheral portion $P_0$ of the main cam plate 10 and the second arm 11B will drop into the recessed peripheral portion of the operation time setting main cam plate 41 to thereby operate the load for 20 minutes. When the pointer dial 14 keeps rotating in the same direction until the pointer indicium 22 reaches the graduation of PM 10 of the third day which is marked on the graduated dial plate 25, the first arm 11A of the operation lever 11 will drop into the recessed peripheral portion $R_0$ of the main cam plate 10 and the second arm 11B will drop into the recessed peripheral portion of the operation time setting main cam plate 41 to thereby operate the load for 20 minutes.

In the case when the selector lever 17 is set to "4" of the operation number indicating scale 27 (see FIG. 1C), the pointer dial 14 will rotate in the direction of arrow B. At the time when the pointer indicium 22 comes into alignment with the dial setting index 26, the first arm 11A of the operation lever 11B will drop into the recessed peripheral portion $P_0$ of the main cam plate 10 and the second arm 11B will drop into the recessed peripheral portion of the operation time setting main cam plate 41 for thereby operating the load for 20 minutes.

When the pointer plate 14 further rotates in the same direction until the pointer indicium 22 reaches the graduation of 10 PM of the forth day which is marked on the graduated dial plate 25, the first arm 11A of the operation lever 11 will drop into the recessed peripheral portion $P_0$ of the main cam plate 10 and the second arm 11B will drop into the recessed peripheral portion of the operation time setting main cam plate 41 to thereby operate the load for 20 minutes.

When the selector lever 17 is set to "OFF" position on the operation number indicating scale 27 (see FIG. 1D), the recessed peripheral portions $P_0$, $Q_0$, $R_0$ and $S_0$ of the main cam plate 10 will be in alignment with the protruded peripheral portions Y, T, U and V of the subsidiary cam plate 12, respectively, so that the operation lever 11 and hence the load will become inoperative.

The timer according to this invention has a wide variety of usage, which will be apparent for those skilled in a art and therefore will not be described herein.

FIG. 8 illustrates a timer according to another embodiment of this invention. The main feature of this embodiment lies in its simplified and compact construction, wherein the main cam plate 10, subsidiary cam plate 12, operation time setting main cam plate 41 and operation time setting subsidiary cam plate 40 are all mounted on the common shaft 35 and the operation lever 11 is pressed against these four cam plates. The other components and parts are similar to those included in said first embodiment and are indicated at like reference symbols and numerals. The operation of this embodiment is also similar to that of the first embodiment, and need not be described.

To summarize the above construction, with emphasis on the novel features of structure and function, it will be apparent to one skilled in the art that what is provided is a highly flexible timer which may be set to turn on a controlled device at different intervals, the selectable intervals, in the present instance, being each day, every two days, or every four days, with the instant of turn-on being settable with a high order of accuracy and with the duration of turn on being adjustable, also with a high order of accuracy.

Notwithstanding the high degree of flexibility which the timer provides, it is of simple construction including a clock 34, which has an associated clutch, and a drive train which includes a set of stepdown gears 33, 31, 29. The gear 29, by means of a shaft 13 drives a "slow" cam 10 which operates, in the present instance on a four day cycle and which is provided with four equally spaced notches as shown in FIG. 4. Cooperating with the slow cam 10 is a cam follower arm 11A which operates a control means in the form of an arm 11C (FIG. 7) which may be used to control a set of contacts or the like. Absent any shielding means, all of the notches would be active to initiate a turn-on cycle at the same time each day. However, in carrying out the invention the slow cam 10 has an associated shielding disc 12 having a plurality of lobes of differing arcuate spacing and which is indexable with respect to the slow cam between a plurality of successive phase positions in which the lobes selectively shield the notches so that only certain desired ones of the notches cause response by the cam follower.

For indicating the phase of the slow cam upon passage of time, the slow cam shaft 13 carries a transparent pointer dial 14 having a pointer 22. The pointer 22 cooperates with a scale on a time dial 25 which underlies the pointer dial and which is stationary but adjustably positionable with respect to an index 26 on the frame.

In initially setting up the unit, the time dial 25 is set, with respect to the pointer 26, to indicate the time of day that a turn-on cycle is to be initiated. The pointer dial 14 is then rotated (accompanied by slipping of the clutch at the motor) counterclockwise, by rotating the knob 36 counterclockwise, until the pointer 22 indicates the correct time of day on the time scale 25. As shown in FIG. 5, the existing time is midnight, and the pointer 22, coming into its vertical position, is initiating a turn-on cycle.

Figure 3:
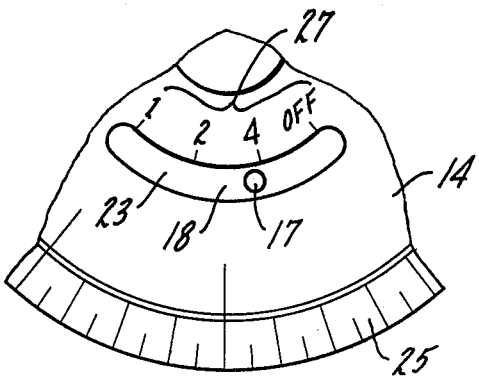
FIG. 3 is an enlarged view of the member adapted to operate one of the two cam plates used in the timer of this invention.

For the purpose of enabling the phase of the shielding disc 12 to be changed with respect to the slow cam 10, the disc is provided with a manually accessible index 17 which projects through an arcuate slot 23 formed in the pointer dial 14. The index cooperates with a scale as shown in FIG. 3 which indicates whether a turn-on cycle is to be initiated each day, every two days, or every four days.

Figure 7:
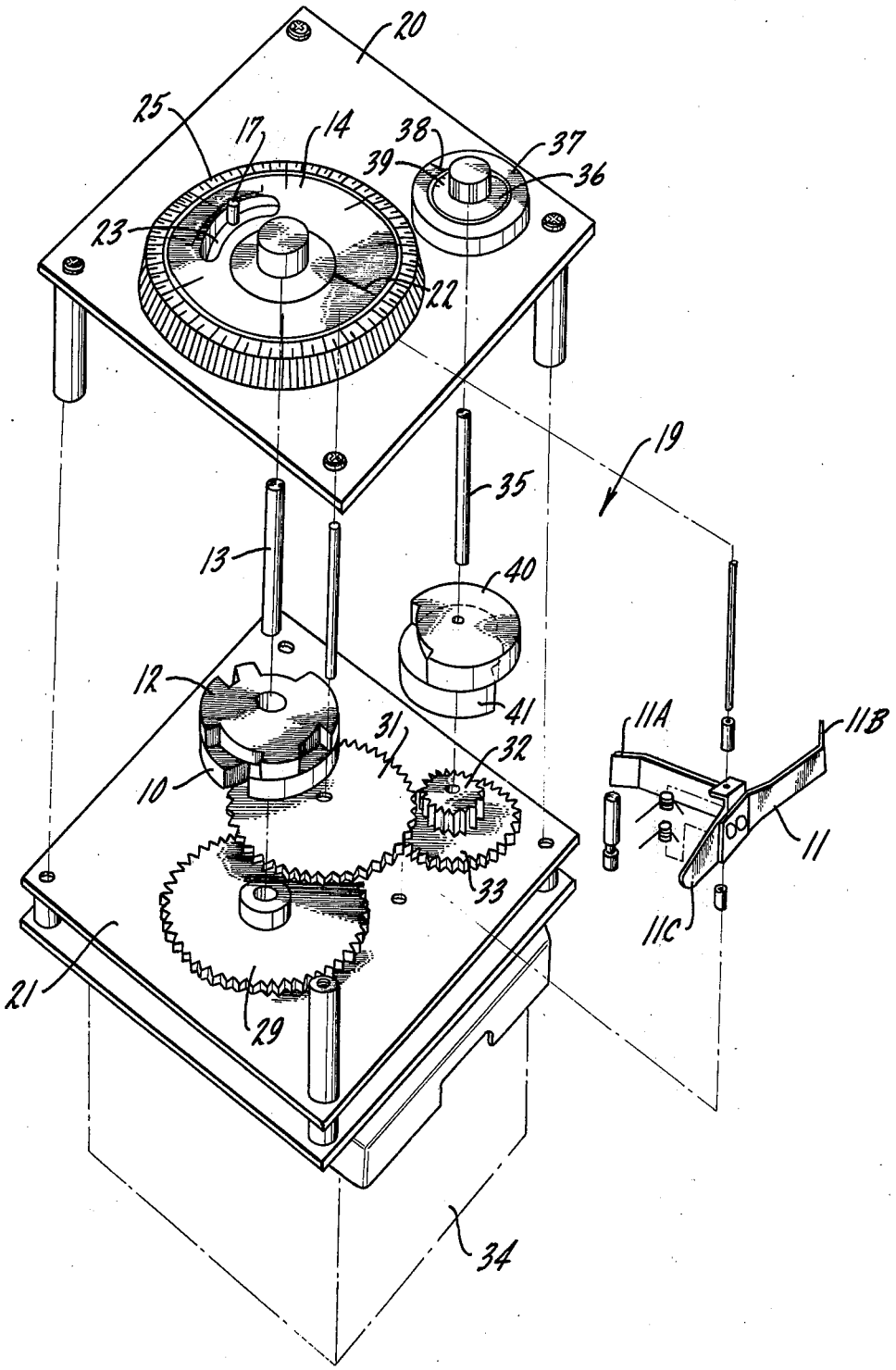
FIG. 7 is an exploded perspective view of the main portion of the timer according to this invention.

In carrying out the invention, a turn-on cycle is initiated, not by the slow cam 10 acting alone, but by joint action between the slow cam and a fast cam 41, the fast cam having a notch formed in its periphery which cooperates with a cam follower 11B which, as shown in FIG. 7, is rigid with the cam follower 11A. Associated with the fast cam 41 is a shielding member 40 which is rotatable therewith and which may be changed in phase to vary the degree of offset and thus effective length of the notch in the fast cam, thereby to enable adjustment of the duration of turn-on. Because the shaft 35 and the fast cam 41 thereon rotate at a speed which is much greater than the speed of the slow cam, the instant turn-on, and the duration of turn-on, may be set with a high order of accuracy and consistency.

To facilitate setting of the duration of turn-on, the fast cam 41 and its shielding member 40 are provided with coaxial knobs 36, 37 at the front panel of the device which respectively carry a scale 39 and index 38 providing a direct indication, in minutes, of the duration of turn-on, the duration, in a practical case, being variable between zero and sixty minutes. To change the duration of turn-on, knob 37 is manually turned while knob 36 is held in position.

It will be apparent, then, that the present construction, employing a slow cam operating on a multiple day cycle (four days in the present instance) and a fast cam operating at a much faster rate on the order of a few hours at most, provides initiation times selectable within a broad time range while preserving a high order of accuracy in the setting and duration of the turn-on interval. The shielding means (members 12 and 40) are simple, compact and easily settable. The drive train consists of a minimum number of gears. As a result the timer assembly may be constructed cheaply and in a package which is highly compact so as to permit usage in a wide number of devices requiring selectable periodic turn-on and intervals of accurate but adjustable duration. For still greater compactness both of the cams and their associated shielding members may be stacked coaxially as indicated in FIG. 8.

We claim:

1. In a timer the combination comprising a frame, a clock motor, a drive train driven by the clock motor and having a slow cam and a fast cam, the slow cam being in the form of a disc having a plurality of notches equally spaced thereon, a slow cam follower movably mounted on the frame and responsive to the arrival of a notch in the cam, a shielding disc adjacent the slow cam and rotatable therewith, the shielding disc having a plurality of lobes of differing arcuate spacing and indexable with respect to the slow cam between a plurality of successive phase positions in which the lobes selectively shield thereby to activate the only desired ones of the notches for response by the slow cam follower, the fast cam having a notch, a fast cam follower movably mounted on the frame and responsive to arrival of such notch, control means operated jointly by the cam followers so that the control means is actuated to initiate a turn-on cycle only when both cam followers respond by dropping into respective notches, the slow cam being provided with a pointer, a time scale for cooperating with the pointer, the time scale being stationary but adjustably positionable on the frame to set the time that a turn-on cycle is initiated, the motor having a clutch to enable manual rotation of the drive train so that the pointer and associated cams are synchronized with the time scale.

2. The combination as claimed in claim 1 in which means are provided for changing the effective length of the notch in the fast cam thereby to adjust the duration of turn-on.

3. The combination as claimed in claim 1 in which the slow cam has a cycle of several days and in which the notches are equally spaced at one day intervals.

4. The combination as claimed in claim 1 in which the shielding disc has an index movable with respect to the pointer to change the phase between the shielding disc and the slow cam thereby to activate the desired ones of the notches on the slow cam while at the same time indicating the number of notches which are activated.

5. The combination as claimed in claim 4 in which the pointer is mounted on a dial having an arcuate clearance slot and in which the index is settable to a desired position within the clearance slot.

6. The combination as claimed in claim 5 in which the pointer dial is in the form of a transparent disc having a pointer and in which the time scale is in the form of a calibrated disc underlying the pointer dial and manually shiftable in phase position with respect to the frame.

7. The combination as claimed in claim 1 in which a multiple detent is provided between the slow cam and the shielding disc to facilitate manual shifting of the disc between a plurality of indexed positions.

8. The combination as claimed in claim 2 in which the fast cam has an associated shielding member adjacent thereto and rotatable therewith, such shielding member having an arcuate lobe and shiftable in phase with respect to the fast cam thereby to vary the effective length of the notch on the fast cam to vary the duration of turn-on.

9. The combination as claimed in claim 1 in which the slow and fast cams are coaxially arranged and in which the respective cam followers are integral with one another.

10. The combination as claimed in claim 1 in which the slow cam follower, fast cam follower and control means are all integral with one another and in the form of a rockable member having three radially extending arms.

11. The combination as claimed in claim 8 in which the fast cam and its shielding member both have coaxial display elements, with an index and time scale being visibly interposed between the display elements for direct display of the duration of turn-on.

* * * * *